United States Patent [19]

Murphy

[11] 4,239,659

[45] Dec. 16, 1980

[54] DETERGENT COMPOSITIONS CONTAINING NONIONIC AND CATIONIC SURFACTANTS, THE CATIONIC SURFACTANT HAVING A LONG ALKYL CHAIN OF FROM ABOUT 20 TO ABOUT 30 CARBON ATOMS

[75] Inventor: Alan P. Murphy, Cincinnati, Ohio

[73] Assignee: The Procter & Gamble Company, Cincinnati, Ohio

[21] Appl. No.: 969,909

[22] Filed: Dec. 15, 1978

[51] Int. Cl.[3] ..... C11D 1/835

[52] U.S. Cl. ..... 252/524; 252/528; 252/542; 252/547

[58] Field of Search ..... 252/547, 528, 117, 8.8, 252/542, 524

[56] References Cited

U.S. PATENT DOCUMENTS

| | | | |
|---|---|---|---|
| 3,537,993 | 11/1970 | Coward et al. | 252/8.75 |
| 3,649,569 | 3/1972 | McCarty | 252/543 |
| 3,959,157 | 5/1976 | Inamorato | 252/547 X |

FOREIGN PATENT DOCUMENTS

| | | | |
|---|---|---|---|
| 2342364 | 9/1977 | France . | |
| 830864 | 3/1960 | United Kingdom | 252/528 |

*Primary Examiner*—Harris A. Pitlick

*Attorney, Agent, or Firm*—Robert B. Aylor; Richard C. Witte; Thomas H. O'Flaherty

[57] ABSTRACT

Laundry detergent compositions, which are either free of phosphate materials or contain only low levels of such materials, containing a nonionic surfactant, preferably specific alcohol ethoxylate nonionic surfactants, together with selected single long chain ($C_{20}$—$C_{30}$) alkyl cationic surfactants, are disclosed. These compositions provide both excellent particulate and greasy/oily soil removal and, additionally, provide fabric softening, static control, color fidelity, and dye transfer inhibition benefits to fabrics laundered therewith. A process for laundering fabrics, using these compositions, is also disclosed.

34 Claims, No Drawings

DETERGENT COMPOSITIONS CONTAINING NONIONIC AND CATIONIC SURFACTANTS, THE CATIONIC SURFACTANT HAVING A LONG ALKYL CHAIN OF FROM ABOUT 20 TO ABOUT 30 CARBON ATOMS

TECHNICAL FIELD

This invention relates to laundry detergent compositions, particularly those of the phosphate-free or low phosphate variety, which provide outstanding removal of both particulate and greasy/oily soils, as well as desirable fabric conditioning benefits, in the course of a conventional, automatic laundering operation.

BACKGROUND ART

Cationic surfactants have long been known as useful additives in laundry detergent compositions for the purpose of providing the laundered fabrics with a static control benefit (see e.g., U.S. Pat. No. 3,951,879, Wixon, issued Apr. 20, 1976, and U.S. Pat. No. 3,959,157, Inamorato, issued May 25, 1976, both of which are incorporated herein by reference), a fabric softening benefit (see e.g., U.S. Pat. No. 3,607,763, Salmen et al, issued Sept. 21, 1971, U.S. Pat. No. 3,644,203, Lamberti et al, issued Feb. 22, 1972, and U.S. Pat. No. 3,537,993, Coward et al, issued Nov. 3, 1970, all of which are incorporated herein by reference), or a sanitization benefit (see e.g., U.S. Pat. No. 2,742,434, Kopp, issued Apr. 17, 1956, U.S. Pat. No. 3,539,520, Cantor et al, issued Nov. 10, 1970, and U.S. Pat. No. 3,965,026, Lancz, issued June 22, 1976, all of which are incorporated herein by reference). However, it is only very recently that it has been discovered that by combining specific types of cationic surfactants with a narrowly defined range of alcohol ethoxylate-type nonionic surfactants, within defined nonionic:cationic ratios, simple, unbuilt detergent compositions, which deliver outstanding cleaning performance, may be formulated (see e.g., U.S. Patent Application Ser. No. 919,181, Murphy, filed June 26, 1978, U.S. Patent Application Ser. No. 919,341, Cockrell, filed June 26, 1978, and U.S. Patent Application Ser. No. 885,931, Murphy, filed Mar. 13, 1978, now abandoned all of which are incorporated herein by reference). However, when these compositions are formulated, since the nonionic:cationic ratio for optimum removal of greasy/oily soils is generally different from that required for optimum removal of particulate soils, it is necessary to either sacrifice optimum removal of one soil type in order to obtain optimum removal of the other type, use additional components, such as the amides disclosed in U.S. Patent Application Ser. No. 919,340, Cambre, filed June 26, 1978, incorporated herein by reference, to enhance soil removal, or else choose an intermediate nonionic:cationic ratio at which excellent, but not optimum, cleaning for both types of soils is obtained.

It has now been found that by using a specific type of cationic surfactant (i.e., single long chain alkyl quaternary ammonium materials) in nonionic/cationic surfactant systems, the optimum nonionic:cationic ratios for clay and grease/oil removal can be made to coincide or at least be close enough to each other to permit optimum removal of both types of soil with a single detergent composition, while also providing static control, softening, color fidelity, and dye transfer inhibition benefits to fabrics laundered therewith. The level of particulate and greasy/oily [especially fatty acid-derived soils (such as triolein) on polyester fabrics] soil removal achieved by the compositions of the present invention, even when formulated without builders, is outstanding.

It is, therefore, an object of this invention to provide low or no phosphate laundry detergent compositions which simultaneously demonstrate outstanding removal of both particulate and greasy/oily soils.

It is another object of this invention to provide laundry detergent compositions, containing cationic and nonionic surfactants, which yield optimum clay removal and optimum greasy/oily soil removal at approximately the same nonionic:cationic ratio.

It is yet another object of this invention to provide laundry detergent compositions, yielding excellent particulate and greasy/oily soil removal, which may conveniently be produced in a variety of physical forms, such as liquid, solid, paste, granular, powder, or in conjunction with a carrier, such as a substrate.

It is further object of this invention to provide a single composition which yields outstanding cleaning performance together with fabric softening, static control, color fidelity, and dye transfer inhibition benefits.

It is a still further object of this invention to provide a process for laundering fabrics which yields exceptional particulate and greasy/oily (especially fatty acid-derived) soil removal, over a range of water hardness conditions, using cationic and nonionic surfactant-containing detergent compositions.

SUMMARY OF THE INVENTION

The present invention relates to laundry detergent compositions, which simultaneously yield outstanding removal of both particulate and greasy/oily soils, containing from 0 to about 20% phosphate materials, comprising from about 5% to about 100% of a surfactant mixture consisting essentially of:

(a) a nonionic surfactant having an HLB of from about 5 to about 17; and (b) a cationic surfactant having the formula $R(R')_3N^+Z^-$, wherein R is an alkyl group containing an average of from about 20 to about 30 carbon atoms, each R' is an alkyl or hydroxyalkyl group containing from 1 to 4 carbon atoms, or a benzyl group with no more than one R' in a molecule being benzyl, and Z is an anion selected from the group consisting of halides, hydroxide, nitrate, sulfate, and alkyl sulfates;

the ratio, by weight, of said nonionic surfactant to said cationic surfactant being from about 1:1 to about 40:1.

Preferred nonionic surfactants, because of their excellent performance and biodegradability capabilities, are those having the formula $R(OC_2H_4)_nOH$, wherein R is a primary or secondary alkyl chain of from about 8 to about 22 carbon atoms and n is an average of from about 2 to about 12.

DETAILED DESCRIPTION OF THE INVENTION

The compositions of the present invention comprise, by weight, from about 5 to about 100%, preferably from about 10 to about 95%, and most preferably from about 20 to about 90%, of a mixture of particularly defined nonionic and cationic surfactants in the ratios stated herein. Preferred compositions contain at least about 15% of the nonionic/cationic surfactant mixture and at least about 1% of the cationic component, itself, in order to assure the presence of a sufficient amount of both the cationic surfactant and the surfactant mixture to provide the desired cleaning and fabric conditioning benefits.

The compositions of the present invention contain the nonionic and cationic surfactants, defined hereinafter, within nonionic:cationic ratios (by weight) of from about 1:1 to about 40:1. Preferred compositions have nonionic:cationic ratios of from about 1:1 to about 20:1, and it is within this range that optimum particulate soil removal performance, for a given pair of nonionic and cationic surfactants, generally takes place. More preferred compositions, especially those which are being optimized for the removal of greasy/oily soils, have nonionic:cationic ratios of from about 3:1 to about 15:1, particularly from about 4:1 to about 10:1.

Preferred compositions of the present invention are formulated so as to have a pH of at least about 7, preferably at least about 7.5, and particularly at least about 8, in the laundry solution, at conventional usage concentrations, in order to achieve the best overall cleaning performance, while minimizing the possibility of washing machine corrosion. In addition to the initial alkaline pH in the laundry solution, these preferred compositions should be formulated to maintain a pH in the laundry solution of from about 8 to 11 throughout the washing operation (reserve alkalinity). Such a reserve alkalinity may be obtained by incorporating compounds which buffer at pH's of from about 8 to 11, such as monoethanolamine, diethanolamine, or triethanolamine, into the compositions.

It is also preferred that compositions of the present invention be essentially free of oily hydrocarbon materials and solvents, such as mineral oil, paraffin oil and kerosine, since these materials, which are themselves oily in nature, load the washing liquor with excessive oily material, thereby diminishing the cleaning effectiveness of the compositions.

NONIONIC COMPONENT

Nonionic surfactants, having HLBs of from about 5 to about 17, preferably from about 8.5 to about 14, more preferably from about 10 to about 13.5, which are conventionally used in detergent compositions, may be used in the compositions of the present invention. Such surfactants include the condensation product of one mole of a saturated or unsaturated, straight or branched chain carboxylic acid having from about 10 to about 18 carbon atoms with from about 5 to about 50 moles of alkylene (particularly ethylene) oxide; the condensation product of one mole of saturated or unsaturated, straight or branched chain alcohol having from about 10 to about 24 carbon atoms with from about 5 to about 50 moles of alkylene (especially ethylene) oxide; polyethylene glycols having a molecular weight of from about 400 to about 30,000; and the condensation product of one mole of alkyl phenol wherein the alkyl chain contains from about 8 to about 18 carbon atoms with from about 4 to about 50 moles of ethylene oxide. Further disclosure of nonionic surfactants useful in the present invention is found in U.S. Pat. No. 3,862,058, Nirschl and Gloss, issued Jan. 21, 1975, incorporated herein by reference. Preferred nonionic surfactants for use in the compositions of the present invention, because of their excellent biodegradability and performance characteristics, have the formula $R(OC_2H_4)_nOH$, wherein R is a primary or secondary, straight or branched alkyl chain containing an average of from about 8 to about 22, preferably from about 10 to about 18, carbon atoms, and n is an average of from about 2 to about 12, preferably from about 2 to about 9, especially from about 2 to about 7. These nonionic surfactants have an HLB (hydrophilic-lipophilic balance) of from about 5 to about 17, preferably from about 8.5 to about 14, and most preferably from about 10 to about 13.5. HLB, an indicator of a surfactant's hydrophilic or lipophilic nature, is defined in detail in *Nonionic Surfactants*, by M. J. Schick, Marcel Dekker, Inc., 1966, pp. 607–613, incorporated herein by reference.

Preferred nonionic surfactants for use in the present invention include the condensation product of coconut alcohol with 5 or 7 moles of ethylene oxide, the condensation product of tallow alcohol with 6, 9, or 11 moles of ethylene oxide, the condensation product of secondary $C_{15}$ alcohol with 5 or 9 moles of ethylene oxide, the condensation product of $C_{12}$–$C_{13}$ alcohol with 4, 5, 6.5, or 9 moles of ethylene oxide, the condensation product of $C_{12-15}$ alcohol with 7 or 9 moles of ethylene oxide, the condensation product of $C_{12}$ alcohol with 5 moles of ethylene oxide, the condensation product of $C_{14-15}$ alcohol with 4, 5, 7, or 9 moles of ethylene oxide, and mixtures thereof.

A preferred class of surfactants utilizes alcohols which contain about 20% 2-methyl branched isomers, and are commercially available, under the tradename Neodol, from the Shell Chemical Company. Particularly preferred nonionic surfactants for use in the compositions of the present invention where optimum particulate soil removal is desired include the condensation product of $C_{12}$ alcohol with 5 moles of ethylene oxide, the condensation product of $C_{12-13}$ alcohol with 6.5 moles of ethylene oxide (e.g., Neodol 23-6.5), the condensation product of $C_{12-13}$ alcohol with 3 moles of ethylene oxide (e.g., Neodol 23-3), and the same condensation product which is stripped so as to remove lower and nonethoxylated fractions, the condensation product of $C_{14-15}$ alcohol with 4 moles of ethylene oxide (e.g., Neodol 45-4), the condensation product of $C_{14-15}$ alcohol with 7 moles of ethylene oxide (e.g., Neodol 45-7), and mixtures thereof. Particularly preferred nonionic surfactants where optimization of greasy/oily soil removal is desired include the condensation product of $C_{12}$ alcohol with 5 moles of ethylene oxide, the condensation product of $C_{12-13}$ alcohol with 6.5 moles of ethylene oxide (e.g., Neodol 23-6.5), the condensation product of $C_{12-13}$ alcohol with 9 moles of ethylene oxide (e.g., Neodol 23-9), the condensation product of $C_{14-15}$ alcohol with 7 moles of ethylene oxide (e.g., Neodol 45-7), and mixtures thereof.

The compositions of the present invention may contain mixtures of nonionic surfactants falling within the above preferred nonionic surfactant definition, such as a mixture of the condensation product of $C_{12-13}$ alcohol with 6.5 moles of ethylene oxide with the condensation product of $C_{14-15}$ alcohol with 7 moles of ethylene oxide, in a ratio of from about 4:1 to about 1:4. The present invention may also contain mixtures of nonionic surfactants, some of which do not fall within the above preferred nonionic surfactant definition (such as alcohol ethoxylates having an average of greater than about 12 ethylene oxide groups per molecule), and in such mixtures it is preferred that at least one of the nonionic surfactants contained in the mixture falls within the above preferred nonionic surfactant definition and that this preferred nonionic surfactant (or mixture of surfactants) be included in an amount such that it falls within the nonionic/cationic ratio range required herein. Where the nonionic surfactant mixture contains a nonionic surfactant (or surfactants) which fall outside of the above preferred nonionic surfactant definition, it is preferable that the ratio of the surfactant (or surfactants) within the definition to those outside the definition be within the range of from about 1:1 to about 10:1.

In addition to the required nonionic surfactant, preferred nonionic surfactant mixtures also contain alkyl glyceryl ethers. Particularly preferred are glyceryl ethers having the formulae

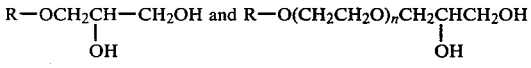

wherein R is an alkyl or alkenyl group of from about 8 to about 18, preferably from about 8 to 12, carbon atoms or an alkaryl group having from about 5 to 14 carbon atoms in the alkyl chain, and n is from 1 to about 6. These compounds may be used together with the nonionic surfactant component of the present invention, in a ratio of nonionic surfactant to glyceryl ether of from about 1:1 to about 4:1, particularly about 7:3. Glyceryl ethers of the type useful in the present invention are disclosed in U.S. Pat. No. 4,098,713, Jones, issued July 4, 1978, and U.S. Patent Applicaton Ser. No. 904,656, Jones, filed May 10, 1978, both of which are incorporated herein by reference.

Another preferred group of nonionic surfactants useful herein comprises a mixture of "surfactant" and "co-surfactant", containing at least one nonionic surfactant falling within the definition of the nonionic surfactants useful herein, as described in U.S. Patent Application Ser. No. 557,217, Collins, filed Mar. 10, 1975, now abandoned, the disclosure of which is incorporated herein by reference.

CATIONIC COMPONENT

The cationic components used in the compositions of the present invention must be of the single long chain alkyl quaternary ammonium type, having one alkyl chain which contains an average of from about 20 to about 30 carbon atoms, preferably from about 20 to about 25 carbon atoms, and most preferably from about 20 to about 22 carbon atoms. An example of such a compound, made from a naturally-occurring material, is a rapeseed oil-derived tri-methyl quaternary ammonium material. An especially preferred cationic material for use herein is the single long chain alkyl $C_{20-22}$ quaternary ammonium compound sold under the tradename Genamin KDM, by American Hoechst Corp. The remaining groups attached to the quaternary nitrogen atom are preferably $C_1$–$C_4$ alkyl (especially methyl or ethyl groups) or hydroxyalkyl groups, or a benzyl group, as long as no more than one such benzyl group is contained per molecule.

Thus, cationic surfactants useful in the present invention have the formula $R(R')_3N^+Z^-$, wherein R is an alkyl group containing an average of from about 20 to about 30 carbon atoms, each R' is an alkyl or hydroxyalkyl group containing from 1 to 4 carbon atoms, or a benzyl group with no more than one R' in a molecule being benzyl, and Z is an anion selected from the group consisting of halides, hydroxide, nitrate, sulfate, and alkyl sulfates, preferably chloride, bromide, or methylsulfate. In a given cationic molecule, all of the R' components may be the same, or each one may represent a different substitutent group.

Preferred cationic surfactants are those having the formulae

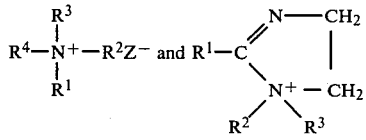

wherein one of the $R^1$, $R^2$, $R^3$, or $R^4$ groups is an alkyl chain averaging from about 20 to about 30 carbon atoms, all of the remaining R substituents are $C_1$–$C_4$ alkyl or hydroxyalkyl groups, and Z is a compatible anion as defined above.

Mixtures of the above surfactants are also useful in the present invention. The cationic surfactants may also be mixed with other types of cationic surfactants, such as sulfonium, phosphonium, and di- or tri-long chain quaternary ammonium materials, as long as the amount of required cationic surfactant contained in the composition falls within the nonionic:cationic ratio requirements specified herein. Examples of other cationic materials which may be used together with those required herein include those described in U.S. Patent Application Ser. No. 885,931, Murphy, filed Mar. 13, 1978, now abandoned; and U.S. Patent Application Ser. No. 919,181, Murphy; U.S. Patent Application Ser. No. 919,341, Cockrell; U.S. Patent Application Ser. No. 919,343, Letton; and U.S. Patent Application Ser. No. 919,344, Letton; all of which were filed on June 26, 1978, and which are incorporated herein by reference.

Examples of cationic surfactants useful herein include eicosyl alkyl ($C_{20}$) trimethyl (or triethyl, methyldiethyl, or methyldihydroxyethyl) ammonium chloride (or methyl sulfate), docosyl ($C_{22}$) alkyl trimethylammonium chloride (or methyl sulfate), $C_{20-22}$ alkyl trimethylammonium chloride (or methyl sulfate), methyl (1) eicosylalkyl amido ethyl (2) methyl imidazolinium chloride (or methyl sulfate), methyl (1) hydroxyethyl amido ethyl (2) docosylalkyl imidazolinium methyl sulfate (or bromide), or mixtures of those surfactants.

Utilizing the nonionic and cationic components, defined above, preferred compositions of the present invention may be formulated using the guidance provided by the reduced monomer concentration of the cationic component ($C_R$) in the laundry solution. Specifically, the selection of a $C_R$ value for a given nonionic and cationic surfactant pair will determine the ratio in which to combine those surfactants. A given nonionic/-cationic surfactant pair will give its best particulate or grease/oil removal performance when it is formulated to have a $C_R$ value which falls within the ranges defined herein. The reduced monomer concentration of a surfactant is obtained by dividing the concentration of the surfactant monomer present in the laundry solution by the critical micelle concentration (CMC) of that surfactant. As used in this application, CMCs are determined at 105° F. in water containing 7 grains/gallon of mixed hardness, unless otherwise stated.

The concept of reduced cationic monomer concentration is explained in detail in U.S. Patent Application Ser. No. 919,181, Murphy, filed June 26, 1978; Tamamushi and Tamaki, *Proceedings of the Second International Congress of Surface Activity*, III, 449, Academic Press, Inc. (1957); and Clint, *J. Chem. Soc. Far. Trans.*, I, 71, 1327 (1975), all of which are incorporated herein by reference. The reduced cationic monomer concentration of the nonionic/cationic surfactant mixture is defined by equations (a) through (c), below. In systems where grease/oil removal is to be optimized it is preferred that the $C_R$ value of the nonionic/cationic surfactant mixture be in the range of from about 0.002 to about 0.2, especially from about 0.002 to about 0.15, most preferably from about 0.002 to about 0.08. In compositions wherein the particulate soil removal capabilities are to be optimized, it is preferred that the nonionic/cationic surfactant mixture have a $C_R$ of from 0.005 to about 0.2, especially from about 0.008 to about 0.15, most preferably from about 0.01 to about 0.1. It is in the area of overlap (i.e., $C_R$ equals about 0.005 to about 0.2) of these $C_R$ ranges that the compositions of the present invention yield both optimum particulate and greasy/oily soil removal.

In the following equations these abbreviations are used:

| | | |
|---|---|---|
| $C_1^*$ | = | critical micelle concentration of nonionic surfactant (moles per liter) |
| $C_2^*$ | = | critical micelle concentration of cationic surfactant (moles per liter) |
| $\beta$ | = | a constant based upon the heat of mixing = −2.8 |
| e | = | base of Napierian logarithm system = 2.71828 |
| x | = | mole fraction of the nonionic surfactant in the micelle at concentration C |
| $f_1$ | = | nonionic activity coefficient in the mixed micelle = $e^{\beta(1-x)2}$ |
| $f_2$ | = | cationic activity coefficient in the mixed micelle = $e^{\beta x2}$ |
| $\Delta$ | = | $f_2C_2^* - f_1C_1^*$ |
| $M_1$ | = | molecular weight of nonionic surfactant |
| $M_2$ | = | molecular weight of cationic surfactant |
| W | = | total analytical surfactant concentration in the solution (ppm) = sum of the cationic and nonionic concentrations |
| Y | = | weight fraction of nonionic surfactant in the composition |

Where a desired $C_R$ value or range is selected, and $\beta$, $C_1^*$, $C_2^*$, $M_1$ and $M_2$ are known for given nonionic/cationic surfactant pair, the corresponding nonionic:cationic ratio(s) is calculated as follows:

(a) for a given nonionic surfactant, cationic surfactant, and for each end of the $C_R$ range desired, solve for x using the equation $$(1-x)e^{\beta x2} = C_R$$

by standard numerical iterative techniques to an error in x of less than 0.001;

(b) find the range of Y from the equation $$\frac{Y(1-x)}{M_1} - \frac{x(1-Y)}{M_2} = \frac{1000}{W}[x(x-1)\Delta]$$

using 100 ppm and 10,000 ppm as the boundary values for W, for each end of the desired $C_R$ range;

(c) the nonionic/cationic ratio(s) (NCR) corresponding to the $C_R$ value or range selected is then obtained by substituting the boundary values for Y into the formula $$NCR = \frac{Y}{1-Y}$$

In addition to these reduced cationic monomer concentration criteria, compositions which give the best performance on greasy/oily soils also satisfy specific cloud point requirements, given below, and detailed in U.S. Patent Application Ser. No. 919,181, Murphy, filed June 26, 1978, incorporated herein by reference. Thus, these preferred compositions have nonionic/cationic mixtures which exhibit a cloud point between about 10° C. and 70° C., more preferably between about 20° C. and 70° C., especially between about 30° C. and about 50° C. The compositions will exhibit their best grease/oil removal performance when the temperature of the wash solution in which they are used falls within about 20° C., preferably within about 15° C., and most preferably within about 10° C., of the cloud point of the nonionic/cationic surfactant mixture.

As used herein, the term "cloud point" means the temperature at which a graph plotting the light scattering intensity of the composition versus wash solution temperature begins to sharply increase to its maximum value, under the following experimental conditions:

The light scattering intensity is measured using a Model VM-12397 Photogoniodiffusometer, manufactured by Societé Francaise d'instruments de controle et d'analyses, France (the instrument being hereinafter referred to as SOFICA). The SOFICA sample cell and its lid are washed with hot acetone and allowed to dry. The surfactant mixture is made and put into solution with distilled water at a concentration of 1000 ppm. Approximately a 15 ml. sample of the solution is placed into the sample cell, using a syringe with a 0.2$\mu$ nucleopore filter. The syringe needle passes through the sample cell lid, so that the cell interior is not exposed to atmospheric dust. The sample is kept in a variable temperature bath, and both the bath and the sample are subject to constant stirring. The bath temperature is heated using the SOFICA's heater and cooled by the addition of ice (heating rate $\approx$1° C./minute); the temperature of the sample is determined by the temperature of the bath. The light scattering (90° angle) intensity of the sample is then determined at various temperatures, using a green filter and no polarizer in the SOFICA.

ADDITIONAL COMPONENTS

In particularly preferred embodiments of the present invention, the detergent compositions additionally contain from about 2 to about 25%, preferably from about 2 to about 16%, and most preferably from about 3 to about 10% of a fatty amide surfactant. The ratio of the cationic/nonionic surfactant mixture to the amide component in the composition is in the range of from about 5:1 to about 50:1, preferably from about 8:1 to about 25:1. The addition of the amide component results in a composition which exhibits improved soil antiredeposition characteristics. This development is described in greater detail in U.S. Patent Application Ser. No. 919,340, Cambre, filed June 26, 1978, and incorporated herein by reference.

The compositions of the present invention may also contain additional ingredients generally found in laundry detergent compositions, at their conventional art-established usage levels, as long as these ingredients are compatible with the nonionic and cationic components required herein. For example, the compositions may contain up to about 15%, preferably up to about 5%, and most preferably from about 0.1% to about 2%, of a suds suppressor component. Typical suds suppressors useful in the composition of the present invention include, but are not limited to, those described below.

Preferred silicone-type suds suppressing additives are described in U.S. Pat. No. 3,933,672, issued Jan. 20, 1976, Bartolotta et al., incorporated herein by reference. The silicone material can be represented by alkylated polysiloxane materials such as silica aerogels and xerogels and hydrophobic silicas of various types. The silicone material can be described as a siloxane having the formula:

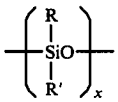

wherein x is from about 20 to about 2,000, and R and R' are each alkyl or aryl groups, especially methyl, ethyl, propyl, butyl and phenyl. Polydimethylsiloxanes (R and R' are methyl), having a molecular weight within the range of from about 200 to about 200,000, and higher, are all useful as suds controlling agents. Additional suitable silicone materials wherein the side chain groups R and R' are alkyl, aryl, or mixed alkyl and aryl hydrocarbyl groups exhibit useful suds controlling properties. Examples of such ingredients include diethyl-, dipropyl-, dibutyl-, methylethyl-, phenylmethyl-polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably tri-methylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active, detergent-impermeable carrier.

Particularly useful suds suppressors are the self-emulsifying silicone suds suppressors, described in U.S. Pat. No. 4,075,118, Gault et al, issued Feb. 21, 1978, incorporated herein by reference. An example of such a compound is DB-544, commercially available from Dow Corning, which contains a siloxane/glycol copolymer together with solid silica and a siloxane resin.

Microcrystalline waxes having a melting point in the range from 35° C.–115° C. and a saponification value of less than 100 represent additional examples of a preferred suds regulating component for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates and monooleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g. monostearyl phosphate, up to about 50 mole percent of dialkyl phosphate and up to about 5 mole percent of trialkyl phosphate.

Other adjunct components which may be included in the compositions of the present invention, in their conventional art-established levels for use (i.e., from about 0 to about 40%), includes semi-polar nonionic (such as amine oxide), anionic, zwitterionic and ampholytic co-surfactants; detergency builders; bleaching agents; bleach activators; soil suspending agents; soil release agents; corrosion inhibitors; dyes; fillers; optical brighteners; germicides; pH adjusting agents; alkalinity sources; hydrotropes; enzymes; enzyme-stabilizing agents; perfumes; solvents; carriers; suds modifiers (such as suds boosters); opacifiers; and the like. However, because of the numerous and diverse performance advantages of the present invention, certain conventional components, such co-surfactants and detergency builders, as well as fabric softening and static control agents, will not generally be necessary in a particular formulation, giving the compositions of the present invention cost and processing advantages over conventional detergent/solftener compositions. In fact, because the compositions of the present invention give such outstanding particulate and greasy/oily soil removal performance, even in a builder-free environment, across the range of water hardness conditions, for environmental reasons the compositions of the present invention contain less than about 20% phosphate materials. Preferred compositions contain less than about 10% phosphate materials and may even be substantially or totally free of such phosphate materials, without materially decreasing their soil removal capabilities. Examples of conventional co-surfactants and detergency builders which may be used in the compositions of the present invention, as long as they are compatible with the particular nonionic and cationic surfactants included in the compositions, are found in U.S. Pat. No. 3,717,630, Booth, issued Feb. 20, 1973, and U.S. Patent Application Ser. No. 919,181, Murphy, filed June 26, 1978, both of which are incorporated herein by reference.

The compositions of the present invention may be produced in a variety of forms, including liquid, solid, granular, paste, powder or substrate compositions. Preferred substrate articles may be formulated according to U.S. Patent Application Ser. No. 781,378, Flesher et al, filed Mar. 25, 1977, now U.S. Pat. No. 4,170,565 incorporated herein by reference. In a particularly preferred embodiment, the compositions of the present invention are formulated as liquids and contain up to about 20% of a lower alkyl ($C_1$ to $C_4$) alcohol, particularly ethanol.

The compositions of the present invention are used in the laundering process by forming an aqueous solution containing from about 0.01 (100 parts per million) to about 0.3% (3,000 parts per million), preferably from about 0.02 to about 0.2%, and most preferably from about 0.03 to about 0.15%, of the nonionic/cationic detergent mixture, and agitating the soiled fabrics in that solution. The fabrics are then rinsed and dried. When used in this manner, the compositions of the present invention yield exceptionally good particulate soil and greasy/oily soil removal (especially triolein soils from polyester fabrics), and also provide fabric softening, static control, color fidelity, and dye transfer inhibition to the laundered fabrics, without requiring the use of any of the other conventionally-used fabric softening and/or static control laundry additives.

All percentages, parts, and ratios used herein are by weight unless otherwise specified.

The following nonlimiting examples illustrate the compositions and the method of the present invention.

EXAMPLE I

The clay and triolein soil removal capabilities of various compositions of the present invention were tested in the manner described herein. To determine clay soil removal for a given composition, a cotton swatch, a polyester knit swatch, and a cotton/polyester blend (65/35) swatch were soiled with a solution of clay in water and the L, a, and b reflectance values of the swatches were determined using a Hunter Whiteness Meter. These values were also determined for each swatch prior to soiling. The three swatches were then placed in an 80 cycle per minute tergotometer and run through one 10 minute wash cycle and two 2 minute rinse cycles, using a wash solution of the detergent composition being tested. The detergent compositions were used at a concentration of 1000 ppm in 1000 milliliters of water containing about 7 grains per gallon of natural calcium and magnesium hardness. The wash temperature was about 105° F. and the rinse temperature was about 70° F. At the conclusion of the washing process, the fabric swatches were tumble dried in an electric mini-dryer, and their L, a, and b reflectance values were again determined. The percent clay soil removal was then calculated using the formula $100\times[L(wash)-L(soiled)]/[L(clean)-L(soiled)]$. The percent clay removal for each composition was averaged over the three fabric types tested.

To determine the triolein removal performance for each composition tested, two 6.1 centimeter square swatches of desized polyester knit fabric were desiccated for at least three hours and were weighed. Each swatch was then soiled with 200 milligrams of MC&B technical grade triolein, containing 0.0083% Oil Red-O added for visualization, and the soil was allowed to age for between 4 to 6 hours. The soiled swatches were then weighed again, and washed in a tergotometer using the same procedure and conditions described above for the clay removal test. After the completion of the washing operation, the swatches were air dried on a frame, and then weighed. The percent triolein removed was calculated using the formula $100\times$[weight (soiled)-weight (washed)]/[weight (soiled)-weight (clean)].

The compositions tested were mixtures of Genamin KDM (a $C_{20-22}$ alkyltrimethylammonium chloride, available from American Hoechst Corp.) with the condensation product of 6.5 moles of ethylene oxide with $C_{12-13}$ alcohol (Neodol 23-6.5), the condensation product of 9 moles of ethylene oxide with $C_{12-13}$ alcohol (Neodol 23-9), the condensation product of 7 moles of ethylene oxide with $C_{14-15}$ alcohol (Neodol 45-7), and the condensation product of 9 moles of ethylene oxide with $C_{14-15}$ alcohol (Neodol 45-9), at various nonionic: cationic ratios, and the results are summarized below.

| Nonionic:cationic ratio | % Clay Removal | % Triolein Removal |
|---|---|---|
| | Neodol 23-6.5/Genamin KDM | (wash solution pH = 7.9) |
| 0 | 70 | 13 |
| 1.67:1 | 74 | 22 |
| 3:1 | 77 | 55 |
| 7:1 | 80 | 97 |
| 15:1 | 75 | 60 |
| ∞ | 70 | 0 |
| | Neodol 23-9/Genamin KDM | (wash solution pH = 8.2) |
| 0 | 70 | 12 |
| 1.67:1 | 70 | 23 |
| 3:1 | 72 | 50 |
| 7:1 | 74 | 92 |
| 15:1 | 74 | 36 |
| ∞ | 72 | 3 |
| | Neodol 45-7/Genamin KDM | (wash solution pH = 8.0) |
| 0 | 69 | 12 |
| 1.67:1 | 74 | 20 |
| 3:1 | 76 | 45 |
| 7:1 | 78 | 91 |
| 15:1 | 74 | 37 |
| ∞ | 70 | 0 |
| | Neodol 45-9/Genamin KDM | (wash solution pH = 8.3-8.4) |
| 0 | 69 | 12 |
| 1.67:1 | 72 | 19 |
| 3:1 | 74 | 30 |
| 7:1 | 74 | 76 |
| 15:1 | 75 | 19 |
| ∞ | 73 | 0 |

It is seen from the above data that when the cationic and nonionic surfactants of the present invention are combined at the proper nonionic:cationic ratio (generally about 7:1), the resulting compositions give excellent removal of both clay and triolein soils, and that each of these compositions has a single nonionic:cationic ratio at which excellent removal of both types of soils may be obtained.

Substantially similar results are obtained where the cationic surfactant used in the above compositions is substituted, in whole or in part, with eicosylalkyltrimethylammonium chloride, eicosylalkyltrimethylammonium methyl sulfate, eicosylalkyltriethylammonium chloride, eicosylalkylmethyldiethylammonium chloride, eicosylalkylmethyldihydroxyethylammonium chloride, docosylalkyltrimethylammonium chloride, docosylalkyltrimethylammonium methyl sulfate, $C_{20}$–$C_{22}$ alkyltrimethylammonium chloride, $C_{20-22}$ alkyltrimethylammonium methyl sulfate, methyl(1)-eicosylalkylamidoethyl(2)methylimidazolinium chloride, methyl(1)eicosylalkylamidoethyl(2)methylimidazolinium methyl sulfate, methyl(1)hydroxyethylamidoethyl(2)docosylalkylimidazolinium methyl sulfate, methyl(1)hydroxyethylamidoethyl(2-)docosylalkylimidazolinium bromide, or mixtures of those surfactants.

Substantially similar results are also obtained where the nonionic surfactant in the above compositions is replaced, in whole or in part, with the condensation product of coconut alcohol with 5 or 7 moles of ethylene oxide, the condensation product of tallow alcohol with 6, 9, or 11 moles of ethylene oxide, the condensation product of secondary $C_{15}$ alcohol with 5 or 9 moles of ethylene oxide, the condensation product of $C_{12-13}$ alcohol with 4 or 5 moles of ethylene oxide, the condensation product of $C_{12-15}$ alcohol with 7 or 9 moles of ethylene oxide, the condensation product of $C_{12}$ alcohol with 5 moles of ethylene oxide, the condensation product of $C_{14-15}$ alcohol with 4 or 5 moles of ethylene oxide, or mixtures thereof.

Excellent soil removal results are also obtained where the level of cationic and nonionic surfactants contained in the detergent composition is reduced from 100% to 90%, 75%, 65%, 50%, 40%, or 30%, and the remainder of said composition is selected from the group consisting of fatty amide surfactants, suds suppressor components, water, $C_1$–$C_4$ alcohols, solvents, semi-polar nonionic, anionic, zwitterionic, or ampholytic cosurfactants, detergency builders, bleaching agents, bleach activators, soil suspending agents, soil release agents, corrosion inhibitors, dyes, fillers, optical brighteners, germicides, pH adjusting agents, alkalinity sources, hydrotropes, enzymes, enzyme stabilizing agents, perfumes, carriers, suds modifiers (such as suds boosters), opacifiers, and mixtures thereof.

EXAMPLE II

The clay and triolein soil removal performance of a 5:1 mixture of Neodol 23-6.5 and Genamin KDM was compared to those of a high phosphate, fully built granular laundry detergent composition, using the procedure described below.

The washing operation was carried out in a full size Kenmore automatic washer, using the normal washing cycle with a 105° F. wash temperature and a 70° F. rinse temperature. 17.1 gallons of water, containing about 10 grains per gallon of mixed calcium and magnesium hardness, were used for the wash test; the composition of the present invention was used at a wash solution concentration of 500 ppm and the control composition was used at a concentration of 1400 ppm (at these usage levels, the surfactant concentrations for the two compositions were approximately equal). For each of the two detergent compositions a wash load was fashioned containing a 6 lb. cleaned fabric ballast, three clay stained swatches (one each of polyester, cotton, and polyester/cotton blend) and two polyester swatches impregnated with a known weight of MC&B triolein containing Oil Red-O. The soiled swatches were prepared as is described in Example I. The fabric load was then washed using the composition to be tested, and the percent clay removal and percent triolein removal were determined as described in Example I.

The composition of the present invention, under the wash conditions stated above, yielded a percent clay soil removal of 85% and a triolein removal of 86%, while the control composition yielded a clay soil removal of about 84% and a triolein removal of about 30%. Thus, it is seen that the completely unbuilt composition of the present invention provided equivalent clay removal performance, without the presence of any builders, and yielded very clear triolein removal benefits over the high phosphate, fully built, granular laundry detergent composition tested herein.

EXAMPLE III

A heavy-duty liquid laundry detergent composition, having the formula given below, is formulated by mixing together the following components in the stated proportions.

| Component | Wt. % |
|---|---|
| $C_{12-13}$ alcohol polyethoxylate containing an average of 6.5 moles of ethylene oxide ($C_{12-13}$ $E_{6.5}$) | 42.0 |
| Genamin KDM[1] | 6.0 |
| Ethanol | 10.0 |
| Water, fluorescer, perfume, minors | balance to 100 |

[1] $C_{20-22}$ alkyltrimethylammonium chloride sold by American Hoechst Corp.

This composition, when used in a conventional laundering operation, yields outstanding removal of both particulate and greasy/oily soils.

EXAMPLE IV

A heavy-duty liquid laundry detergent composition of the present invention, having the formula given below, is formulated by mixing together the following components in the stated proportions.

| | |
|---|---|
| $C_{14-15}$ alcohol polyethoxylate containing an average of 7 moles of ethylene oxide ($C_{14-15}$ $E_7$) | 30.0 |
| $C_{20-22}$ alkyltrimethylammonium methyl sulfate | 6.0 |
| Monoethanolamine | 5.5 |
| Ethanol | 5.0 |
| Water and minors | balance to 100 |

This product, when used in an automatic laundering operation at a concentration of about 0.1%, provides excellent removal of greasy/oily, body, and particulate soils, as well as providing static control, fabric softening, color fidelity and dye transfer inhibition benefits to the fabrics laundered therewith.

EXAMPLE V

A solid particulate detergent composition of the present invention, having the formulation given below, is made in the manner described herein. The nonionic and cationic components are mixed together, and are then mixed with the solid urea, while concurrently being warmed. The resultant product is then mixed with the remaining components to form the final detergent composition. This product, when used in an automatic laundering operation at conventional usage concentrations, provides excellent particulate and greasy/oily soil removal.

| Component | Wt. % |
|---|---|
| $C_{12}$ alcohol polyethoxylate containing an average of 5 moles of ethylene oxide ($C_{12}E_5$) | 45.0 |
| $C_{20-22}$ alkyltrimethylammonium chloride | 3.0 |
| Urea | 30.0 |
| Sodium tripolyphosphate | 10.0 |
| Minors (including suds suppressor, brightener, moisture) | balance to 100 |

EXAMPLE VI

A solid particulate detergent composition of the present invention, having the formulation given below, is made in the manner described in Example V.

| Component | Wt. % |
|---|---|
| $C_{12}E_5$ | 39.0 |

-continued

| Component | Wt. % |
|---|---|
| Methyl(1)hydroxyethylamidoethyl(2) docosylalkylimidazolinium methyl sulfate | 5.0 |
| Urea | 25.0 |
| Sodium carbonate | 15.0 |
| Sodium silicate (2.0r) | 15.0 |
| Moisture and minors | balance to 100 |

This product, when used in an automatic washing machine at conventional usage concentrations, provides excellent particulate and greasy/oily soil removal performance, as well as fabric softening, color fidelity, static control and dye transfer inhibition benefits to the laundered fabrics.

EXAMPLE VII

A heavy-duty liquid laundry detergent composition, having the formula given below, is made by combining the ingredients in the proportions specified.

| Component | Wt. % |
|---|---|
| $C_{14-15}E_7$ | 23.62 |
| Genamin KDM | 5.25 |
| Ethanol | 15.00 |
| Coconutalkylmonoethanol amide | 2.88 |
| Perfume | 0.35 |
| Water | balance to 100 |

This composition demonstrates outstanding removal of both particulate and greasy/oily, especially triolein, soils, and fabric softening, static control, color fidelity, and dye transfer inhibition benefits when used to launder fabrics.

What is claimed is:

1. A detergent composition, containing from 0 to about 20% phosphate materials, comprising from about 5% to about 100% of a surfactant mixture consisting essentially of:

(a) a nonionic surfactant having an HLB of from about 5 to about 17; and (b) a cationic surfactant having the formula $R(R')_3N^+Z^-$, wherein R is an alkyl group containing an average of from about 20 to about 30 carbon atoms, each R' is an alkyl or hydroxyalkyl group containing from 1 to 4 carbon atoms, or a benzyl group with no more than one R' in a molecule being benzyl, and Z is an anion selected from the group consisting of halides, hydroxide, nitrate, sulfate, and alkyl sulfates;

the ratio, by weight, of said nonionic surfactant to said cationic surfactant being from about 3:1 to about 15:1.

2. A composition according to claim 1 which contains from about 10% to about 95% of said surfactant mixture.

3. A composition according to claim 2 wherein the ratio of said nonionic surfactant to said cationic surfactant is from about 4:1 to about 10.1.

4. A composition according to claim 3 wherein the cationic surfactant is selected from the group consisting of

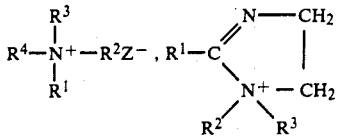

$Z^-$, and mixtures thereof, wherein one of said $R^1$, $R^2$, $R^3$ and $R^4$ substituents is an alkyl chain averaging from about 20 to about 30 carbon atoms, the remainder of said substituents being selected from the group consisting of $C_1$–$C_4$ alkyl, or $C_1$–$C_4$ hydroxyalkyl groups and Z is selected from the group consisting of halides, hydroxide, nitrate, sulfate, or alkyl sulfate.

5. A composition according to claim 4 wherein, in said cationic surfactant, R is an alkyl group containing an average of from about 20 to about 25 carbon atoms.

6. A composition according to claim 1 wherein said nonionic surfactant has the formula $R(OC_2H_4)_nOH$, wherein R is a primary or secondary alkyl chain of from about 8 to about 22 carbon atoms and n is an average of from about 2 to about 12.

7. A composition according to claim 1 wherein the pH of said composition is above about 7.5.

8. The composition of claim 7 wherein the pH is above about 8.

9. The composition of claim 8 containing reserve alkalinity sufficient to maintain wash solutions prepared therewith within the pH range of from about 8 to about 11.

10. A composition according to claim 7 which contains from about 10% to about 95% of said surfactant mixture.

11. A composition according to claim 10 wherein the ratio of said nonionic surfactant to said cationic surfactant is from about 4:1 to about 10:1.

12. A composition according to claim 11 wherein, in said nonionic surfactant, R is an alkyl chain of from about 10 to about 18 carbon atoms.

13. A composition according to claim 12 wherein, in said nonionic surfactant, n is an average of from about 2 to about 9.

14. A composition according to claim 13 wherein the cationic surfactant is selected form the group consisting of

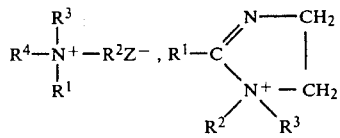

$Z^-$, and mixtures thereof, wherein one of said $R^1$, $R^2$, $R^3$ and $R^4$ substituents is an alkyl chain averaging from about 20 to about 30 carbon atoms, the remainder of said substituents are selected from the group consisting of $C_1$–$C_4$ alkyl, or $C_1$–$C_4$ hydroxyalkyl groups and Z is selected from the group consisting of halides, hydroxide, nitrate, sulfate, or alkyl sulfate.

15. A composition according to claim 10 wherein, in said cationic surfactant, R is an alkyl group containing an average of from about 20 to about 25 carbon atoms.

16. A composition according to claim 13 wherein, in said cationic surfactant, R is an alkyl group containing an average of from about 20 to about 25 carbon atoms.

17. A composition according to claim 10 wherein said nonionic surfactant has an HLB of from about 8.5 to about 14.

18. A composition according to claim 16 wherein said nonionic surfactant has an HLB of from about 8.5 to about 14.

19. A composition according to claim 18 wherein said nonionic surfactant is selected from the group consisting of the condensation product of coconut alcohol with 5 or 7 moles of ethylene oxide, the condensation product of tallow alcohol with 6, 9, or 11 moles of ethylene oxide, the condensation product of secondary $C_{15}$ alcohol with 5 or 9 moles ethylene oxide, the condensation product of $C_{12-13}$ alcohol with 4, 5, 6.5, or 9 moles of ethylene oxide, the condensation product of $C_{12-15}$ alcohol with 7 or 9 moles of ethylene oxide, the condensation product of $C_{12}$ alcohol with 5 moles of ethylene oxide, the condensation product of $C_{14-15}$ alcohol with 4, 5, 7, or 9 moles of ethylene oxide, and mixtures thereof.

20. A composition of claim 18 wherein said nonionic surfactant has an HLB of from about 10 to about 13.5.

21. A composition according to claim 19 wherein said nonionic surfactant is selected from the group consisting of the condensation product of $C_{12}$ alcohol with 5 moles of ethylene oxide, the condensation product of $C_{12-13}$ alcohol with 6.5 moles of ethylene oxide, the condensation product of $C_{12-13}$ alcohol with 9 moles of ethylene oxide, the condensation product of $C_{14-15}$ alcohol with 7 moles of ethylene oxide, and mixtures thereof.

22. A composition according to claim 13 wherein said nonionic surfactant is selected from the group consisting of the condensation product of $C_{12}$ alcohol with 5 moles of ethylene oxide, the condensation product of $C_{12-13}$ alcohol with 3 moles of ethylene oxide, and the same condensation which is stripped so as to remove unethoxylated and lower ethoxylate fractions, the condensation product of $C_{12-13}$ alcohol with 6.5 moles of ethylene oxide, the condensation product of $C_{14-15}$ alcohol with 4 moles of ethylene oxide, the condensation product of $C_{14-15}$ alcohol with 7 moles of ethylene oxide, and mixtures thereof.

23. A composition according to claim 16 wherein, in said cationic surfactant, each R′ is a methyl group.

24. A composition according to claim 23 wherein, in said cationic surfactant, R is an alkyl group containing an average of from about 20 to about 22 carbon atoms.

25. A composition according to claim 24 wherein, in said cationic surfactant, Z is selected from the group consisting of chloride, bromide, methyl sulfate, and mixtures thereof.

26. A composition according to claim 10 wherein, in said cationic surfactant, each R′ is a methyl group.

27. A composition according to claim 26 wherein, in said cationic surfactant, R is an alkyl group containing an average of from about 20 to about 22 carbon atoms.

28. A composition according to claim 10 which contains from 0 to about 10% phosphate materials.

29. A composition according to claim 28 which is substantially free of phosphate materials.

30. A composition according to claim 10 which contains from about 20% to about 90% of said surfactant mixture.

31. A composition according to claim 6 wherein said surfactant mixture has a cloud point of from about 10° C. to about 70° C.

32. A composition according to claim 31 wherein said surfactant mixture has a reduced cationic monomer concentration of from about 0.002 to about 0.2.

33. A composition according to claim 6 wherein said surfactant mixture has a reduced cationic monomer concentration of from about 0.005 to about 0.2.

34. A method of cleaning fabrics, while simultaneously providing fabric softening, static control, color fidelity, and dye transfer inhibition benefits, said method comprising the agitation of the fabrics in an aqueous solution containing from about 0.01 to about 0.3% of the detergent composition of claim 1.

* * * * *